United States Patent [19]

Tidman

[11] Patent Number: 4,901,621

[45] Date of Patent: Feb. 20, 1990

[54] SUPERCONDUCTING PROJECTILE FOR A RAIL GUN AND THE COMBINATION OF A RAIL GUN WITH A SUPERCONDUCTING PROJECTILE

[75] Inventor: Derek A. Tidman, Silver Spring, Md.

[73] Assignee: GT-Devices, Alexandria, Va.

[21] Appl. No.: 79,291

[22] Filed: Jul. 9, 1987

[51] Int. Cl.[4] ..... F41F 1/02

[52] U.S. Cl. ..... 89/8; 102/520; 124/3; 174/125.1; 505/1; 505/884

[58] Field of Search ..... 89/8; 102/501, 517, 102/518, 519, 520, 532; 124/3; 174/125.1; 505/813, 884, 885, 886, 887

[56] References Cited

U.S. PATENT DOCUMENTS

| | | | |
|---|---|---|---|
| 3,612,742 | 10/1971 | Snowden et al. | 174/125.1 |
| 3,638,154 | 1/1972 | Sampson et al. | 174/125.1 |
| 4,467,696 | 8/1984 | McNab et al. | 89/8 |
| 4,485,720 | 12/1984 | Kemeny | 89/8 |
| 4,576,082 | 3/1986 | Scuro | 89/8 |
| 4,647,888 | 3/1987 | Woolf et al. | 174/125.1 |
| 4,785,142 | 11/1988 | Smith et al. | 174/125.1 |

OTHER PUBLICATIONS

Kolm et al I, Electromagnetic Launchers, Proceedings of the 14th Intersociety Energy Conversion Engineering Conference, 1979, pp. 2004–20012.

Kolm et al II, Electromagnetic Launchers and Guns, ADA 143778, Jun. 1980, pp. 80–84.

Sun et al, *Physical Review Letters*, vol. 58, No. 15, Apr. 13, 1987, pp. 1574–1576.

Moodenbaugh et al, *Physical Review Letters*, vol. 58, No. 18, May 4, 1987, pp. 1885–1887.

Murphy et al, *Physical Review Letters*, vol. 58, No. 18, May 4, 1987, pp. 1888–1890.

Hor et al, *Physical Review Letters*, vol. 58, No. 18, May 4, 1987, pp. 1891–1894.

*Primary Examiner*—Stephen C. Bentley

*Attorney, Agent, or Firm*—Lowe, Price, LeBlanc, Becker & Shur

[57] ABSTRACT

A rail gun projectile includes superconducting material. Current from a DC power supply flows between the rails through the superconducting material with a component at right angles to the elongated direction of the rails. The superconducting material is of a type that the current flowing through it produces a force for driving the projectile longitudinally along the rails. Metal abutting against the superconducting material shunts current from the power supply around a portion of the superconducting material having a tendency to go normal to the remainder of the superconducting material in the superconducting state.

47 Claims, 2 Drawing Sheets

SUPERCONDUCTING PROJECTILE FOR A RAIL GUN AND THE COMBINATION OF A RAIL GUN WITH A SUPERCONDUCTING PROJECTILE

FIELD OF INVENTION

The present invention relates generally to projectiles particularly adapted for rail guns and more particularly to a rail gun projectile including an armature having superconducting material.

BACKGROUND ART

One known type of high speed projectile accelerator is classified as a rail gun. Rail guns are characterized as having two parallel, electrically conducting, elongated metallic rails spaced from each other by solid dielectric blocks. Between the rails is an insulating gap where a projectile is located. The rails are connected to opposite terminals of a DC power supply. Current from the power supply traverses a first one of the rails, flows through an armature including a metal region in the projectile or a plasma designed to be immediately behind the projectile and then flows through the second rail back to the power supply. The current flowing through the armature between the rails produces a magnetic field, which in urn produces a mechanical force in the elongated direction of the rails. The mechanical force accelerates the projectile along the length of the rails, typically to maximum speeds on the order of about 5 kilometers per second.

Solid armatures for rail gun projectiles are either solid homogeneous conducting metal blocks or laminated armatures including alternating conducting and insulating layers extending in a direction perpendicular to the acceleration direction of the projectile along the rails. It has been previously realized that laminated armatures are probably preferable to homogeneous armatures because the laminated armatures more readily distribute current uniformly throughout the armature volume. It has been previously shown that uniform current distribution amongst the conductors of a laminated rail gun projectile traversing copper rails can be obtained if:

$$\alpha = \frac{7.5\,l}{a}\left(\frac{\sigma_{arm}}{\sigma_{Cu}}\right)(U_{km/sec}l)^{1/2} \leqq 1 \quad (1)$$

where:

$2a$ is the gap between the rails in centimeters, l is the length of the armature in centimeters, $U_{km/sec}$ is the average velocity of the projectile as it traverses the rails in kilometers per second, $\sigma_{arm}$ is the average conductivity of the conducting and insulating layers in the rail gun armature, and $\sigma_{Cu}$ is the conductivity of copper rails.

The many thin layers of the laminated armature can be viewed as a continuous anisotropic conductor having zero conductivity in the conducting layers in a direction at right angles to the gap between the rails, i.e., the conductivity of the armature in the direction of projectile movement is zero. If the inequality of Equation 1 is not satisfied, current is concentrated in the trailing outer corners of the armature when the projectile is accelerated to high velocity, i.e., a velocity in excess of 5 kilometers per second. Current concentration in the trailing armature outer corners causes extensive ohmic heating in the corners, leading to melting and evaporation of metal and/or dielectric from the corners The evaporation leads to vapor trails behind the projectile, between the rails. The vapor trail provides a medium for breakdown between the rails behind the projectile to shunt current away from the armature, to prevent efficient coupling of current from the rails into the armature.

The inequality of Equation 1 can be satisfied if the armature conductivity is smaller (less than 0.1) than the conductivity of the copper rails. However, such low conductivity layers are not suitable for the projectile armature because the entire armature volume is ohmically heated. The ohmic heating is often sufficiently great to melt the entire laminated armature before the projectile reaches a high velocity, on the order of 5 kilometers per second.

The aforementioned problems with solid armatures have caused plasma arc armatures to be investigated. The plasma arc is established directly behind the projectile, such that the current flowing in the plasma between the rails produces a mechanical force that acts on the rear of the projectile. The plasma arc typically has a conductivity of about $10^{-3}$ times that of copper so that uniform current distributions occur and the solid projectile is not subject to melting because it can be insulated so that no appreciable current flows through it. However, the surfaces of the dielectric spacer blocks between the rails have a tendency to be evaporated due to contact with the hot plasma armature arc, typically at a temperature of between 20,000° K. and 50,000° K. Further, the armature plasma has a very high pressure, in the kilobar range, tending to adversely affect the mechanical stability of the spacer blocks. Further, secondary arcs are frequently formed between the rails at distances somewhat removed from the base of the projectile. The secondary arcs shunt current away from the primary arcs, to lower the device efficiency. The rails also have a tendency to be melted by small subarcs in the armature structure.

THE INVENTION

The present invention avoids the heating problems of the prior art by providing a rail gun projectile with superconducting material arranged so that current from the rail gun power supply flows between the rails through the superconducting material with a component at right angles to the elongated direction of the rails; the superconducting material is of a type that the current flowing through it produces a large force for driving the projectile longitudinally along the rails. Because superconducting materials are employed, the amount of ohmic ($I^2R$) heating is virtually zero so that the previously mentioned problems with the plasma and metallic armatures are obviated. The superconductors are preferably of the newly developed "high temperature" type, such as reported by Sun et al., *Physical Review Letters,* Vol. 58, No. 15, Apr. 13, 1987, pp. 1574–1576; Moodenbaugh et al., *Physical Review Letters,* Vol. 58, Vol. 58, No. 18, May 4, 1987, pp. 1885–1887; Murphy et al., *Physical Review Letters,* Vol. 58, No. 18, May 4, 1987, pp. 1888–1890; Hor et al., *Physical Review Letters,* Vol. 58, No. 18, May 4, 1987, pp. 1891–1894; Ovshinsky et al., *Physical Review Letters,* Vol. 58, No. 24, June 15, 1987, pp. 2579–2581; and Chaudhari et al., *Physical Review Letters,* Vol. 58, No. 25, pp. 2684–2686. The superconductors reported in these articles are particularly advantageous because they are capable of superconducting properties at liquid nitrogen temperatures (77° K.) or higher. These materials are referred to as Type II superconductors and can carry sufficiently high currents in the range above $10^5$ amps per $cm^2$ to generate magnetic pressure forces sufficiently intense to accelerate a projectile containing the superconducting material longitudinally along the elongated rails to a high velocity, in excess of about 10 kilometers per second. While the superconducting, ceramic materials reported in these articles are the preferred embodiments of the present invention at the present time, it is envisioned that, as additional improvements in superconductors occur, more advanced superconducting materials would be employed.

In the preferred embodiment, the superconducting armature of the present invention includes multiple spaced regions of superconducting material arranged so that current from the power supply flows between the rails through the superconducting material with a component at right angles to the elongated direction of the rails. A metal region, between each pair of adjacent superconducting material spaced regions, couples current between the rails to the superconducting material regions. A dielectric region, located between each pair of adjacent spaced superconducting material regions, causes current to be distributed amongst the multiple spaced superconducting material regions.

The metal regions are important because superconducting materials, while at a temperature greater than the temperature necessary for superconductivity (i.e., when the superconductor goes normal), are low conductivity semiconductor ceramics. The portions of the superconducting material closest to the rails have a tendency to be heated to a temperature at which the superconducting material goes normal. The metal regions thus can be considered as a shunt for conducting current past the relatively high temperature normal superconducting material portions to couple current from the rails to the portion of the superconducting material which has not gone normal and is in a superconducting state.

The insulating layers help to distribute the current from the rails to multiple regions along the length of the projectile, so that all of the current is not concentrated in a single region of the projectile. This is important because current flow through superconductors is basically a skin effect mechanism. Thus, the multiple insulator regions in effect cause multiple parallel currents to flow through the multiple superconducting regions to increase the magnetic field and the resulting mechanical force applied to the projectile.

Current distribution to the multiple superconducting regions is enhanced by including first and second metallic layers or skins on the projectile adjacent the rails so that the current from a first of the rails flows via the first metallic layer o the metal regions, thence to the superconducting regions and back to the other rail via the metal regions and the second metallic layer. The skins assist in maintaining projectile mechanical stability in the region where the superconducting metal and dielectric regions are located. The skins are sufficiently thin, i.e., less than $10^{-2}$ cm, that they do not impede distribution of current among the interior superconducting layers in the armature.

Current distribution is further enhanced by dimensioning the projectile such that a short gap subsists between the first and second metallic layers and the rails. The gap is such that frictional and ohmic heating of gas between the rails and the metallic layers causes a plasma to be established in the gap. The plasma is a poor electrical conductor compared to the conductivity of the metal regions and the superconductor. Thereby, current is relatively uniformly distributed from the rails across the plasma gap into the metal and superconductor regions via the metallic layers.

A further feature of the invention is that the discharge plasma current has a minimum volume across the very narrow gap so that the amount of rail and insulator block melting is minimized. This leads to current concentration from the rails in the superconducting armature and precludes the likelihood of secondary plasma arcs being formed behind the projectile.

In one preferred embodiment, the multiple spaced superconducting regions are configured as first strips extending between the rails, while each of the metal regions is configured as a second strip extending between the rails and abuting against one side of the first strips. Each of the dielectric regions in this embodiment is configured as a second strip extending between the rails and abutting against another side of the first strips. In a second embodiment, each of the superconducting regions is configured as a wire and the metal regions are configured as sleeves surrounding and abutting against each of the wires. In the second embodiment, each of the dielectric regions is configured as a insulating matrix in which the sleeves and wires are embedded. While the second configuration is less expensive to manufacture than the first, which typically requires the use of thin film coating fabrication techniques, the first mentioned embodiment is capable of greater mechanical stability as a function of high acceleration forces.

In accordance with another aspect of the invention, there is provided the combination of a rail gun including first and second parallel, elongated electrically conducting rails insulated from each other and connected to opposite terminals of a DC power supply and a projectile including an armature of superconducting material arranged so that current from the power supply flows between the rails through the superconducting material with a component at right angles to the elongated direction of the rails. The superconducting material is of a type that the current flowing through it produces a force for driving the projectile longitudinally along the rails. The projectile is initially located at a position so it can traverse a gap between the rails and be accelerated longitudinally of the rails. The combination further includes means for cooling the projectile while the projectile is at an initial location; the projectile is cooled to a temperature at which all of the superconducting material is in a superconducting state. In a preferred embodiment, the means for cooling includes a cooling jacket surrounding the projectile while it is at its initial location. Liquid nitrogen is supplied to the cooling jacket. To reduce the amount of coolant the rails draw from the superconducting material in the projectile, the projectile is preferably initially located upstream of the rails and is injected by a suitable source, e.g., a gas gun, from its initial position into the gap between the rails.

It is, accordingly, an object of the present invention to provide a new and improved projectile particularly adapted to be used in rail guns.

Another object of the invention is to provide a new and improved rail gun-projectile combination.

A further object of the invention is to provide a new and improved projectile and rail gun-projectile combination wherein prior art problems associated with high temperature armatures for driving the rail guns are obviated.

A further object of the invention is to provide a new and improved rail gun projectile containing a solid superconducting armature that is maintained at relatively low temperatures, even though substantial current flows through it between rails of the rail gun.

An additional object of the invention is to provide a rail gun employing a superconducting armature, wherein the tendency of superconducting material in the armature to go normal in response to heat produced at the interface between the rail gun rails and the armature is circumvented.

Yet another object of the invention is to provide a new and improved rail gun projectile including a superconducting armature wherein the tendency for all current flowing through the superconducting armature in a single, relatively small region is overcome ad current is distributed over a relatively large region of the superconducting armature.

Another object of the invention is to provide a rail gun projectile with a superconducting armature and structure for distributing current in plural parallel paths through the armature.

The above and still further objects, features and advantages of the present invention will become apparent upon consideration of the following detailed description of several specific embodiments thereof, especially when taken in conjunction with the accompanying drawings.

DETAILED DESCRIPTION OF THE INVENTION

Figure 1:
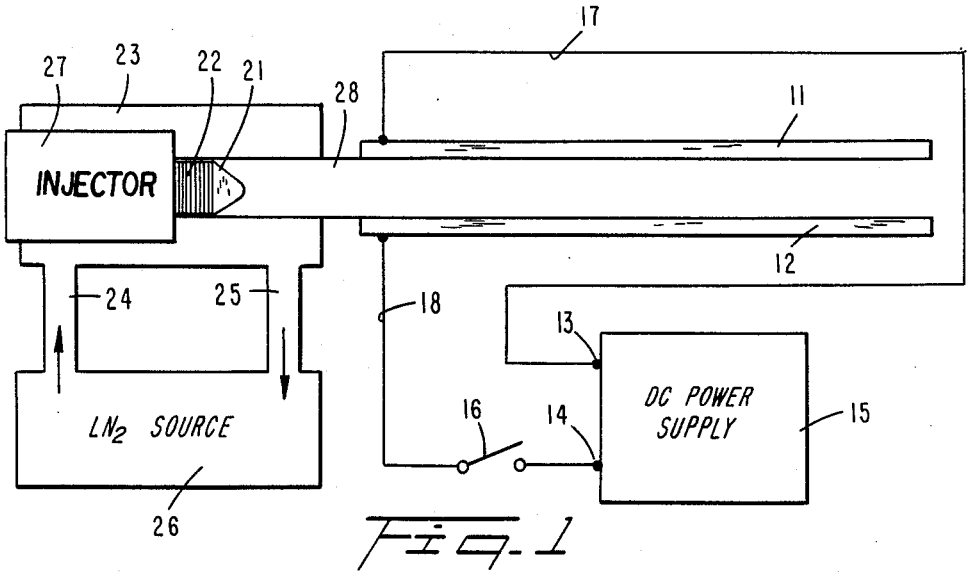
FIG. 1 is an overall schematic view of a superconducting projectile and a rail gun combination in accordance with a preferred embodiment of the present invention.

Reference is now made to FIG. 1 of the drawing, wherein rail gun 11 is illustrated as including elongated, electrically conducting rigid, metal, preferably copper or copper alloy, rails 11 and 12, spaced from each other by dielectric blocks 10 (FIG. 3) and located in a vacuum; the vacuum can be established by locating the structure in a vacuum chamber (not shown) or by locating the structure in outer space. Rails 11 and 12 are secured to dielectric blocks 10 in a conventional manner so the entire structure is located in a containment assay, enabling the structure to withstand the very high pressures generated therein. Mutually insulated rails 11 and 12 are connected to opposite terminals 13 and 14 of DC power supply 15 in response to normally open contacts of switch 16 being closed. Leads 17 and 18, respectively connected to terminal 13 and switch 16, are connected to the ends of rails 11 and 12 adjacent the ends of the rails where projectile 21 enters the gap between the rails. Projectile 21, containing solid superconducting armature 22, is initially located upstream of the entrance of rails 11 and 12, in cooling jacket 23. Jacket 23 surrounds projectile 21 and maintains all of superconducting armature 22 thereof at liquid nitrogen temperature in response to liquid nitrogen being continuously circulated through the jacket while projectile 21 is in the jacket. The liquid nitrogen flows into jacket 23 via pipes 24 and 25 from suitable recirculating source 26.

Positioned immediately behind projectile 21, when the projectile is located at its initial position, is injector 27, of a conventional prior art type. In response to the initial accelerating force from injector 27, projectile 21 is launched via tube 28 into the entrance end of the rail gun, between rails 11 and 12. As projectile 21 enters the gap between rails 11 and 12, switch 16 is closed by an automated timer responsive to activation of injector 27. With switch 16 closed, current flows from power supply terminal 13 through lead 17 to rail 11, thence through superconducting armature 22, through rail 12, lead 18 and switch 16 back to terminal 14.

The current flowing through the rails 11 and 12 causes magnetic fields to be produced. The magnetic fields produce additively related mechanical, Lorentz forces that drive projectile 21 longitudinally along rails 11 and 12 so that the projectile escape velocity from the exit end of the rails is approximately 10 kilometers per second. Because superconducting material is employed in armature 22, there is a minimum amount of current dissipation in the armature. The large magnetic fields and Lorentz forces associated with superconducting armature 22 drive projectile 21 along rails 11 and 12. Armature 22 is maintained essentially at superconducting temperatures the entire time while it traverses rails 11 and 12 due to the cooling provided to the armature by the liquid nitrogen in cooling jacket 23 and the very short resident time, e.g., 1 millisecond, of projectile 21 in rails 11 and 12.

Figure 2:
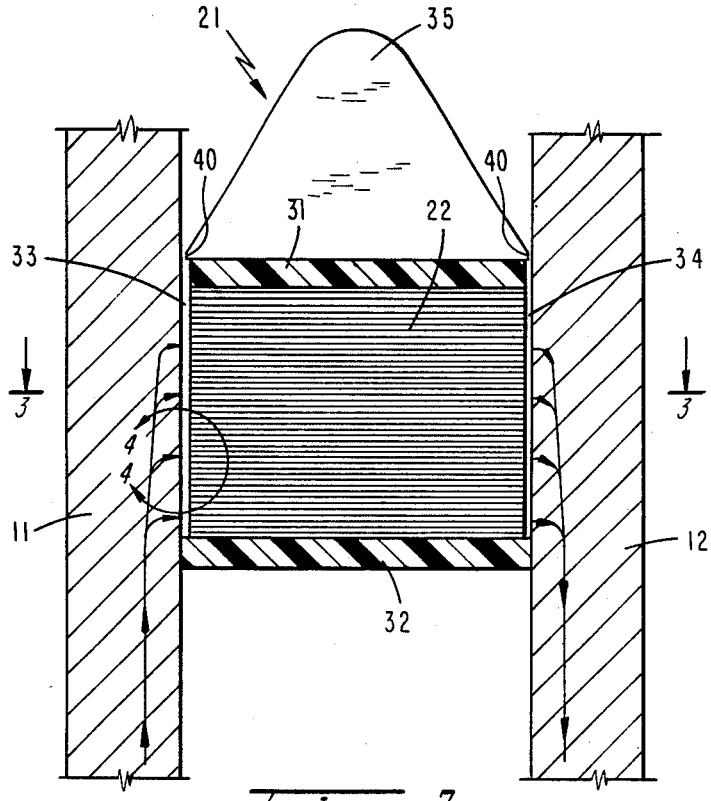
FIG. 2 is a side view of a portion of the structure illustrated in FIG. 1, in greater detail.
Figure 3:
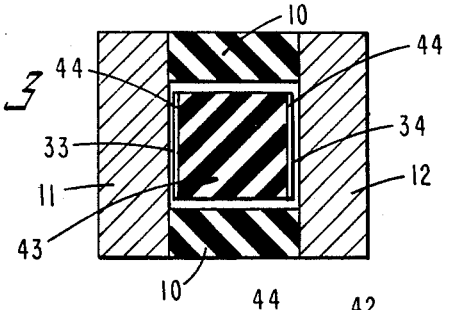
FIG. 3 is a sectional view taken through the lines 3—3 of FIG. 2.
Figure 4:
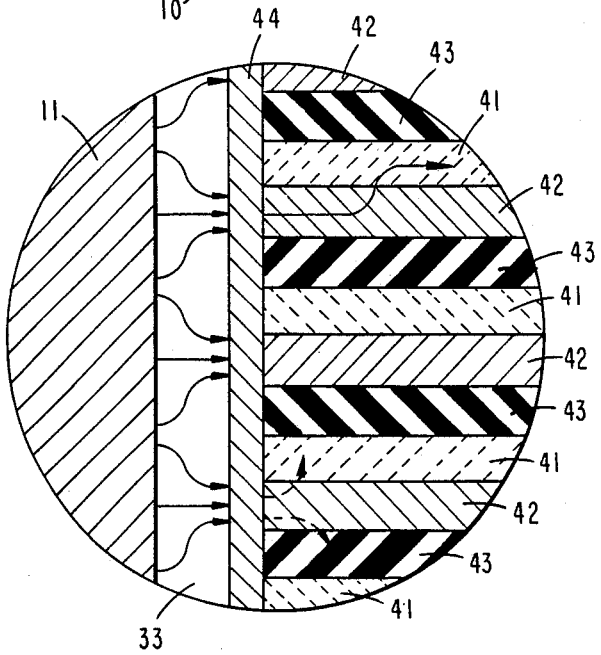
FIG. 4 is an enlarged view of a portion of FIG. 2, indicated by circled region 4—4.

Reference is now made to FIGS. 2, 3 and 4 of the drawing wherein projectile 21 is illustrated in greater detail than in FIG. 1. As illustrated in FIG. 2, projectile 21 includes superconducting armature 22, dielectric plates 31 and 32 and dielectric nose cone 35. Armature 22 is positioned between plates 31 and 32 which extend completely between rails 11 and 12. In contrast, gaps 33 and 34 subsist between the side walls of superconducting armature 22 and rails 11 and 12; typically, gaps 33 and 34 are 50 microns wide. A plasma is formed in gaps 33 and 34 in response to the gas evaporated from the projectile side walls in the gaps being heated by multiple discharges between rails 11 and 12 and the side walls of the superconducting armature 22. The plasma in gaps 33 and 34 has a low electrical conductivity compared to the electrical conductivity of rails 11 and 12 and of metal and superconducting segments in armature 21. Because of the tight fit between plates 31 and 32 and rails 11 and 12, the plasma is confined to gaps 33 and 34 and does not generally act as a short circuit behind projectile 21 to shunt current between rails 11 and 12.

Dielectric nose cone 35 is positioned ahead of and integral with electrically insulating plate 31. Cone 35 provides streamlined flow of projectile 21 while the projectile is traversing the space between rails 11 and 12, and after the projectile has been launched from the exit end of the rail gun.

Slots 40 extend longitudinally of projectile 21 through nose cone 35 and plate 31 into gaps 33 and 34 to vent gases from the gaps to regions in front of the nose cone between rails 11 and 12. Venting gas ahead of nose cone 35 prevents excessive plasma pressure from occurring in gaps 33 and 34. If excessive plasma pressure occurs in gaps 33 and 34, the plasma in the gaps is liable to squirt between plate 32 and rails 11 and 12, into the region behind projectile 21. This is to be avoided because the plasma behind projectile 21 between rails 11 and 12 is likely to shunt current away from the projectile and prevent the development of large Lorentz forces against the projectile.

As illustrated in FIG. 4, superconducting armature 22 includes superconducting region 41, metal, electrically conducting region 42 and dielectric regions 43. Each of regions 41, 42 and 43 extends between rails 11 and 12 at right angles to the elongated direction of the rails. Extending longitudinally of projectile 21, abutting against the edges of regions 41–43, is electrically conducting, metal skin 44, which traverses the space between electrically insulating plates 31 and 32.

In a preferred embodiment, each of regions 41–43 is a thin film layer or strip, typically having a thickness equal approximately to the thickness of the skin effect depth of current flowing in superconductor region 41; a typical thickness for each of strip or layer regions 41–43 is thus 0.1 micron. Strips of regions 41–43 are typically vacuum deposited on one or both of plates 31 and 32, between which the strips are compressed. It is to be understood that regions 41–42 can be thicker than 0.1 micron and that region 41 can be made of powder superconducting crystals. Each of strip regions 41 is a Type II, ceramic superconductor having low thermal conductivity relative to regions 42. Each of strip regions 42 is a highly electrically conductive metal, such as copper or aluminum, while each of strip regions 43 is a dielectric, such as Lexan. Electrically conducting skins 44 are high electrical conductivity metal layers, such as copper or aluminum. The thickness of each of skins 44 is such that magnetic fields resulting from current flowing between rails 11 and 12 via gaps 33 and 34 diffuse through and penetrate the skins. Skins 44 provide mechanical protection and a uniform width for gaps 33 and 34 between rails 11 and 12 and superconducting armature 22.

When projectile 21 is in the initial position thereof in cooling jacket 23, all of superconducting regions 41 are wholly in a superconducting state. In response to projectile 21 being accelerated into the gap between rails 11 and 12, the portions of regions 41 abutting against conducting skins or layers 44 on opposite sides of superconducting armature 22 become heated to a temperature whereby the exterior portions of regions 41 go normal, i.e., the exterior portions of regions 41 no longer exhibit superconducting properties and become insulators. One face of each of conductor regions 42 abuts against a face of superconductor regions 41 so that current flowing in rail 11 jumping gap 33 and flowing through skin 44 flows initially into region 42 toward rail 12. The current traverses only a short distance through region 42 between rails 11 and 12 before encountering the portion of region 41 in a superconducting state. When the current flowing transversely of rails 11 and 12 in region 42 encounters the superconducting portion of region 41, the current flows immediately into the much lower superconducting region. Thus, the current in armature 22 flows almost completely across the region between rails 11 and 12 in the portion of region 41 in the superconducting state. The current flowing through the superconducting portion of region 41 flows back into metal region 42 close to the side of superconducting armature 22 adjacent rail 12. The current continues to flow back to rail 12 via region 42 and electrically conducting skin 44, thence through gap 32. Similar parallel paths subsist between rails 11 and 12 through each of abutting regions 41 and 42 of armature 22 between plates 31 and 32.

In response to the current flowing through each of the parallel superconducting regions 41 between rails 11 and 12, a magnetic field is produced. Each magnetic field results in a mechanical, Lorentz force being produced against projectile 21 in a direction extending from the entrance to the exit end of the rail gun. The mechanical forces from all of regions 41 are additive to accelerate projectile 21 to a very high speed by the time the projectile reaches the exit end of the rail gun. The current density in each of superconducting regions 41 is maintained at a relatively low level because of the 0.1 micron thickness of the regions. Thereby, the critical magnetic field, which is a function of both temperature and current density, has a maximum value for the temperature of the superconducting region. Typically, the current flow toward the center of projectile 21 through conducting regions 42 is over a distance in the range of a few hundred microns. After the current has traversed regions 42 for such a distance, regions 41 are in a superconducting state and the current in regions 42 flows axially of the projectile into region 41.

Ohmic heating occurs in the portion of conductor regions 42 which the current traverses. The ohmic heating in conductor regions 42 adds to the heat along the periphery of superconducting armature 22. The ohmic heating by regions 42 of superconductor regions 41 and the heat applied to the superconductor regions from the plasma in gaps 33 and 34 occurs for only a few milliseconds while projectile 21 is traversing rails 11 and 12. During this short period, the low thermal conductivity of superconductor regions 41 prevents substantial migration of the normal segment of regions 41 beyond a few hundred microns from the edges of skins 44.

Insulator regions 43 permit magnetic flux produced in regions 41 and 42 in response to the current flowing through regions 41 and 42 to diffuse rapidly along regions 41 and 42 from the side walls of projectile 21. Thereby, current is shared approximately equally by all of superconducting regions 41.

Thin conducting skins 44 on opposite sides of superconducting armature 22 provide mechanical protection for regions 41–43 and high electric conductivity between the plasma in gaps 31 and 32 and regions 41–43. This is particularly important immediately after projectile 21 has entered the rail gun when the plasma impedance is relatively high. Layers 44 must be sufficiently thin, e.g., 50 microns, so as not to impede the distribution of flux between superconducting regions 41. The magnetic flux must be able to diffuse across the thickness of skin 44 in a few microseconds, i.e., in a time much less than the typical few millisecond acceleration time of projectile 21 from the entrance to the exit ends of rails 11 and 12. If layers or skins 44 have a maximum thickness of approximately 50 microns the requirement for rapid diffusion of magnetic flux is achieved.

Gaps 33 and 34 in effect form plasma bearings between rails 11 and 12 and skins 44 on the side walls of projectile 21. Ionized gas arcs are formed in bearings 33 and 34 to conduct current between rails 11 and 12 and superconducting armature 22. The plasma bearings in gaps 33 and 34 enable magnetic flux and currents to rapidly diffuse along the lengths of the gaps so that the current is distributed approximately uniformly between all of superconducting regions 41. The portions of insulating plates 31 and 32 at the ends of gaps 33 and 34 maintain the gap distance, δa, constant because these portions of the plates extend beyond the gaps into contact with rails 11 and 12. The low conductivity of the plasma in gaps 33 and 34, relative to the conductivity of metal regions 42 and superconducting regions 41, permits rapid diffusion of current between rails 11 and 12 and conductor regions 42.

It can be shown that the length of each of gaps 33 and 34, i.e., the distance between rail 11 and skin 44 on the left side of armature 22 (as viewed in FIGS. 2-3) or the distance from rail 12 to the right side of armature 22, should satisfy:

$$\frac{\delta a}{l} \geqq 7.5\left(\frac{\sigma_{plasma}}{\sigma_{Cu}}\right)(lU_{k/s})^{1/2}$$

where:

δa = the length of the gap, l = the axial length of armature 22 in centimeters, in the direction of motion, $\sigma_{plasma}$ is the conductivity of the plasma in gaps 33 and 34, $\sigma_{Cu}$ is the conductivity of the metal in rails 11 and 12 (typically copper), and $U_{k/s}$ is the velocity of projectile 21 in kilometers per second as it traverses rails 11 and 12 between the entrance and exit ends of the rail gun.

Typically, $U_{k/s}$ is about 7 kilometers per second.

Figure 5:
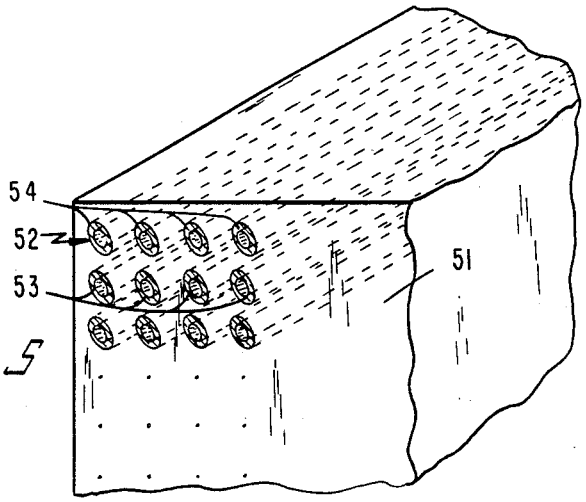
FIG. 5 is a partial perspective view of another embodiment of a projectile in accordance with the invention.

An alternative structure for a superconducting armature 22 is illustrated in FIG. 5, sans conducting layers 44. In the alternative structure of FIG. 5, the superconducting and metallic regions are embedded in a dielectric matrix 51, formed as a right parallelepiped, the same configuration as armature 22. Embedded in dielectric matrix 51 is a matrix of wires 52. Each of wires 52 includes an elongated core 53 fabricated of Type II superconducting material, surrounded by, abutting against and coaxial with metal, preferably aluminum or copper, sleeve 54. Adjacent ones of wires 52 are mechanically and electrically separated and insulated from each other by dielectric matrix 51. Wires 52 are arranged so that the longitudinal axes thereof are parallel, with the axes extending between gaps 33 and 34.

The alternative structure of FIG. 5 functions in basically the same manner as the layered configuration of FIGS. 2 and 3. Superconducting wires 53 have a tendency to go normal at the extreme ends thereof in proximity to gaps 33 and 34. Current thus flows longitudinally from gap 33 in metal sleeves 54 until the superconducting regions of wires 53 are reached, at which point the current in the sleeves flows radially inwardly into and longitudinally through the wires. The current flows longitudinally through wires 53 until the normal position of the wires is encountered, at which point the current flows radially outwardly from the wires into metal sleeves 54. The current flow outwardly from wires 53 occurs in proximity to the other ends of the wires adjacent gap 34. While the structure of FIG. 5 may be slightly less expensive to manufacture than the structure of FIGS. 2 and 3, wires 52 have a tendency to be mechanically unstable when a projectile containing them is accelerated with very high accelerations, such as 50,000 G's, as the projectile traverses the rail gun.

While there have been described and illustrated several specific embodiments of the invention, it will be clear that variations in the details of the embodiments specifically illustrated and described may be made without departing from the true spirit and scope of the invention as defined in the appended claims.

I claim:

1. A projectile for launching from a rail gun including first and second parallel, elongated electrically conducting metal rails insulated from each other and connected to opposite terminals of a DC power supply, the projectile comprising a forward portion, a rear portion, and an armature between the forward and rear portions, the rails and projectile armature being arranged so that current flows from one terminal of the power supply longitudinally of one of the rails thence through the projectile to the other rail thence longitudinally of the other rail back to the other terminal of the supply; the armature having multiple mutually insulated longitudinally extending superconductors arranged so that current flowing longitudinally in the rails from the power supply flows between the rails longitudinally through the superconductors with a component at right angles to the elongated direction of the rails, the superconductors being arranged, positioned and of a type that the current flowing longitudinally through them at right angles to and between the rails produces a force for driving the projectile longitudinally along the rails, the superconductors having a tendency to go normal in the vicinity of the rails in response to heating of the superconductors in the vicinity of the rails while the projectile is travelling along the rails, and means on the projectile for shunting current from the power supply around the portion of the superconductors having a tendency to go normal to the remainder of the superconductors in the superconducting state.

2. The projectile of claim 1 wherein the means for shunting includes a metal region abutting against each of the spaced superconductors.

3. The projectile of claim 1 further including means for distributing the current from the rails to different ones of the spaced superconductors along the length of the projectile.

4. The projectile of claim 3 wherein the current distributing means includes multiple dielectric regions arranged so that each is between adjacent ones of the spaced superconductors.

5. The projectile of claim 4 wherein the current distributing means further includes first and second metallic layers abutting against the armature between the forward and rear portions and extending at right angles to the metal regions and the dielectric regions adjacent the rails so that the current flows from the first rail via the first metallic layer to the metal regions thence to the superconductors and back to the second rail via the metal regions and the second metallic layer.

6. The projectile of claim 5 wherein the the armature has a length between the rails that is slightly less than the distance between the rails, the projectile including means for maintaining a gap between the armature and the rails where the armature length is slightly less than the distance between the rails, the gap being such that frictional heating of gas between the rails and the armature causes a plasma to be established in the gap, the plasma coupling current from the rails to the armature.

7. The projectile of claim 6 wherein the projectile includes means for venting pressure in the gap to a region between the rails ahead of the projectile.

8. The projectile of claim 7 wherein the means for venting includes slot means extending through the means for maintaining to the gap.

9. The projectile of claim 1 further including means for distributing the current from the rails to different ones of the mutually insulated superconductors along the length of the projectile, the current distributing means further including first and second metallic layers abutting against the armature between the foreward and rear portions and extending at right angles to the longitudinally flowing current through the superconductors adjacent the rails so that the current flows from the first rail via the first metallic layer to the current shunting means thence to the superconductors and back to the second rail via the current shunting means and the second metallic layer.

10. The projectile of claim 9 wherein the armature has a length between the rails that is slightly less than the distance between the rails, the projectile including means for maintaining a gap between the armature and the rails where the armature length is slightly less than the distance between the rails, the gap being such that frictional heating of gas between the rails and the armature causes a plasma to be established in the gap, the plasma coupling current from the rails to the armature.

11. The projectile of claim 10 wherein the projectile includes means for venting pressure in the gap to a region between the rails ahead of the projectile.

12. The projectile of claim 11 wherein the means for venting includes slot means extending through the means for maintaining the gap.

13. The projectile of claim 1 wherein the armature has a length between the rails that is slightly less than the distance between the rails, the projectile including means for maintaining a gap between the armature and the rails where the armature length is slightly less than the distance between the rails, the gap being such that frictional heating of gas between the rails and the armature causes a plasma to be established in the gap, the plasma coupling current from the rails to the armature.

14. The projectile of claim 13 wherein the projectile includes means for venting pressure in the gap to a region between the rails ahead of the projectile.

15. The projectile of claim 14 wherein the means for venting includes slot means extending through the means for maintaining the gap.

16. A projectile for launching from a rail gun including first and second parallel, elongated electrically conducting metal rails insulated from each other and connected to opposite terminals of a DC power supply, the projectile comprising a forward portion, a rear portion, and an armature between the forward and rear portions, the rails and projectile armature being arranged so that current flows from one terminal of the power supply longitudinally of one of the rails thence through the projectile to the other rail thence longitudinally of the other rail back to the other terminal of the supply, the armature including multiple spaced mutually insulated longitudinally extending regions of superconducting material arranged so that current flowing longitudinally in the rails from the power supply flows between the rails longitudinally through the multiple spaced regions of the superconductors material with a component at right angles to the elongated direction of the rails, the multiple spaced regions of the superconducting material being arranged, positioned and of a type that the current flowing longitudinally through them produces a force for driving the projectile longitudinally along the rails, a metal region between each of multiple pairs of adjacent spaced regions of superconducting material for coupling current between the rails to the superconducting material regions while the superconducting material in the vicinity of the rails is normal, and a dielectric region extending in the same direction as the regions of superconducting material between each of multiple pairs of adjacent spaced regions of superconducting material for causing said current to be distributed amongst the multiple spaced superconducting material regions.

17. The projectile of claim 16 wherein the multiple spaced superconducting regions are configured as first strips extending between the rails, each of the metal regions being configured as a second strip extending between the rails and abutting against one side of the first strip, and each of the dielectric regions being configured as a second strip extending between the rails and abutting against another side of the first strips.

18. The projectile of claim 17 further including first and second metallic layers abutting against the armature between the forward and rear portions and extending at right angles to the metal regions and the dielectric regions adjacent the rails so that the current flows from the first rail via the first metallic layer to the second strips thence to the first strips and back to the second rail via the second strips and the second metallic layer.

19. The projectile of claim 18 wherein the armature has a length between the rails that is slightly less than the distance between the rails, the projectile including means for maintaining a gap between the armature and the rails where the armature length is slightly less than the distance between the rails, the gap being such that frictional heating of gas between the rails and the armature causes a plasma to be established in the gap, the plasma coupling current from the rails to the armature.

20. The projectile of claims 16 wherein the armature has a length between the rails that is slightly less than the distance between the rails, the projectile including means for maintaining a gap between the armature and the rails where the armature length is slightly less than the distance between the rails, the gap being such that frictional heating of gas between the rails and the armature causes a plasma to be established in the gap, the plasma coupling current from the rails to the armature.

21. The projectile of claim 17 wherein the multiple spaced superconducting regions are configured as wires extending between the rails, each of the metal regions being configured as a sleeve surrounding and abutting against each of the wires and extending between the rails, and each of the dielectric regions being configured as an insulating matrix in which the sleeves and the wires are embedded.

22. In combination, first and second parallel, elongated electrically conducting metal rails insulated from each other and connected to opposite terminals of a DC power supply, a projectile initially located at a position so it can traverse a gap between the rails and be accelerated longitudinally of the rails, the projectile including an armature, the rails and projectile armature being arranged so that current flows from one terminal of the power supply longitudinally of one of the rails thence through the projectile to the other rail thence longitudinally of the other rail back to the other terminal of the supply, the armature having multiple longitudinally extending mutually insulated superconductors arranged so that current flowing longitudinally in the rails from the power supply flows between the rails longitudinally through the superconductors with a component at right angles to the elongated direction of the rails, the superconductors being positioned, arranged and of a type that the current flowing longitudinally through them produces a force for driving the projectile longitudinally along the rails, the superconductors having a tendency to go normal in the vicinity of the rails in response to heating of the superconductors in the vicinity of the rails while the projectile is travelling along the rails, and means on the projectile for shunting current from the power supply around the portion of the superconductors having a tendency to go normal to the remainder of the superconductors in the superconducting state.

23. The combination of claim 1 wherein the means for maintaining includes means for cooling the projectile while it is at its initial location.

24. The combination of claim 23 wherein the means for cooling includes a cooling jacket surrounding the projectile while it is at its initial location.

25. The combination of claim 24 further including means for supplying liquid nitrogen to the cooling jacket.

26. The combination of claim 1 wherein the projectile initial position is upstream of the rails, and further including means for injecting the projectile from the initial position into the gap between the rails.

27. The combination of claim 26 wherein the means for maintaining includes means for cooling the projectile while it is at its initial location.

28. The combination of claim 27 wherein the means for cooling includes a cooling jacket surrounding the projectile while it is at its initial location.

29. The combination of claim 28 further including means for supplying liquid nitrogen to the cooling jacket.

30. The combination of claim 22 wherein the superconductors are arranged as multiple spaced regions of the superconducting material extending longitudinally between the rails, and the means for shunting includes a metal region between each of adjacent ones of the spaced superconducting regions.

31. The combination of claim 30 further including means for distributing the current from the rails to different ones of the spaced superconducting regions along the length of the projectile.

32. The combination of claim 31 wherein the current distributing means includes a dielectric region between each adjacent pair of the spaced regions of the superconducting material.

33. The combination of claim 32 further including first and second metallic layers abutting against the armature between the forward and rear portions and extending at right angles to the metal regions and the dielectric regions adjacent the rails so that the current flows from the first rail via the first metallic layer to the metal regions thence to the superconducting regions and back to the second rail via the metal regions and the second metallic layer.

34. The combination of claim 22 wherein the armature has a length between the rails that is slightly less than the distance between the rails, the projectile including means for maintaining a gap between the armature and the rails where the armature length is slightly less than the distance between the rails, the gap being such that frictional heating of gas between the rails and the armature causes a plasma to be established in the gap, the plasma coupling current from the rails to the armature.

35. The combination of claim 22 further including means for maintaining the projectile while it is at its initial location at a temperature at which all of the superconducting material is in a superconducting state, said means for maintaining being located only at one end of the conducting rails where the projectile is initially located.

36. The combination of claim 34 wherein the projectile includes means for venting pressure in the gap to a region between the rails ahead of the projectile.

37. The combination of claim 36 wherein the means for venting includes slot means extending through the means for maintaining to the gap.

38. In combination, first and second parallel, elongated electrically conducting metal rails insulated from each other and connected to opposite terminals of a DC power supply, a projectile initially located at a position so it can traverse a gap between the rails and be accelerated longitudinally of the rails, the projectile including an armature, the rails and projectile armature being arranged so that current flows from one terminal of the power supply longitudinally of one of the rails thence through the projectile to the other rail thence longitudinally of the other rail back to the other terminal of the supply, the armature having multiple mutually insulated longitudinally extending superconductors arranged so that current flowing longitudinally in the rails from the power supply flows between the rails longitudinally through the superconductors with a component at right angles to the elongated direction of the rails, the superconductors being arranged, positioned and of a type such that said current flows longitudinally through the superconductors at right angles to and between the rails to produce a force for driving the projectile longitudinally along the rails, the armature having a length between the rails that is slightly less than the distance between the rails, the projectile including means for maintaining a gap between the armature and the rails where the armature length is slightly less than the distance between the rails, the gap being such that frictional heating of gas between the rails and the armature causes a plasma to be established in the gap, the plasma coupling current from the rails to the armature.

39. The combination of claim 38 wherein the projectile includes means for venting pressure in the gap to a region between the rails ahead of the projectile.

40. The combination of claim 39 wherein the means for venting includes slot means extending through the means for maintaining to the gap.

41. The combination of claim 22 further including means for maintaining the projectile while it is at its initial location at a temperature at which all of the superconducting material is in a superconducting state.

42. The projectile of claim 1 wherein each of the superconductors while normal has an electric impedance much greater than that of the means for shunting.

43. The projectile of claim 42 wherein each of the superconductors is a ceramic.

44. The projectile of claim 16 wherein the superconducting material while normal has an electric impedance much greater than that of said metal regions.

45. The projectile of claim 44 wherein the superconducting material is a ceramic.

46. The combination of claim 22 wherein each of the superconductors while normal has an electric impedance much greater than that of the means for shunting.

47. The combination of claim 46 wherein each of the superconductors is a ceramic.

* * * * *